US006453953B1

(12) United States Patent
Adriansens et al.

(10) Patent No.: US 6,453,953 B1
(45) **Date of Patent: *Sep. 24, 2002**

(54) FLOWBACK METHOD IN A FILLING MACHINE AND FILLING MACHINE FOR CARRYING OUT SAID METHOD

(75) Inventors: Eric Adriansens; Eric Meunier; Rodolphe Saint-Martin, all of Le Havre Cedex (FR)

(73) Assignee: Sidel, Lehavre Cedex (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/869,838

(22) PCT Filed: Dec. 7, 1999

(86) PCT No.: PCT/FR99/03048

§ 371 (c)(1),
(2), (4) Date: Jul. 6, 2001

(87) PCT Pub. No.: WO00/40503

PCT Pub. Date: Jul. 13, 2000

(30) Foreign Application Priority Data

Jan. 6, 1999 (FR) ..... 99 00117

(51) Int. Cl.[7] ..... B65B 1/20

(52) U.S. Cl. ..... 141/11; 141/89; 141/90; 141/91; 141/285; 141/290; 134/170

(58) Field of Search ..... 141/2, 4, 11, 65, 141/47–50, 54, 63, 89–91, 93, 285, 290; 134/166 R, 170; 222/148, 149

(56) References Cited

U.S. PATENT DOCUMENTS

| | | | | | |
|---|---|---|---|---|---|
| 4,964,444 | A | | 10/1990 | Hanerus et al. | |
| 5,782,274 | A | * | 7/1998 | Kaneko et al. | 141/90 |
| 5,865,221 | A | * | 2/1999 | Ludwig et al. | 141/31 |
| 6,148,874 | A | * | 11/2000 | Rutter et al. | 141/10 |
| 6,267,157 | B1 | * | 7/2001 | Gruson et al. | 141/90 |

FOREIGN PATENT DOCUMENTS

| | | |
|---|---|---|
| EP | 0 673 837 | 9/1995 |
| WO | WO 95/33675 | 12/1995 |

* cited by examiner

*Primary Examiner*—Timothy L. Maust
(74) *Attorney, Agent, or Firm*—Sughrue Mion, PLLC

(57) ABSTRACT

A flowback method for a product contained in the distribution circuit of a filling machine. The distribution circuit (22, 24, 26, 28, 30) creates an upstream/downstream link between a storage tank for said product and a filling tube (22) that is placed opposite the opening of a receptacle (12) that is to be filled. The method includes a step whereby a closed area around the filling tube (22) is defined by a sealed housing (38). The method further includes a step whereby a circulating liquid is injected into the above-mentioned area under pressure. The liquid passes through an auxiliary port (70), whereupon the product contained in the distribution method (22, 24, 26, 28, 30) flows back in the direction of the storage tank.

10 Claims, 3 Drawing Sheets

70
22
34
20
18
A1
12
36
40
32
26
24
30
28
10
16
14

FLOWBACK METHOD IN A FILLING MACHINE AND FILLING MACHINE FOR CARRYING OUT SAID METHOD

BACKGROUND OF THE INVENTION

The invention concerns a flowback process of the product contained in a distribution circuit of a filling machine, the distribution circuit connects upstream to a storage tank of the product up to a filling nozzle that is intended to be brought opposite the opening of a container to be filled.

This process is more especially intended to be implemented in machines that permit filling hollow containers, such as bottles or jars, with a product, for example a liquid food product.

Such machines can include a rotary carousel provided with a series of filling nozzles, each nozzle then being supplied by the distribution circuit. The containers are inserted onto the carousel at a given point of the circle that it describes that is arranged below a filling nozzle. Once the container is in place under the nozzle, the latter is supplied by product in such a way that the product is poured inside the container. When a desired degree of filling is reached, the nozzle supply is interrupted by a valve inserted in the distribution circuit and the container is then released by the carousel, of course before the carousel has perform one full turn.

In a machine in operation therefore a certain quantity of product exists permanently in transit in the distribution circuit between the storage tank and the distribution nozzle. This quantity of product increases of course with the number of nozzles that the machine carries.

However, at the time of the filling operation shutdown, when this shutdown is scheduled, for example at the end of production, or that it is unscheduled, for example when the production line experiences a problem on which the filling machine is located down stream from the machine, this quantity of product is trapped in the distribution circuit, and this trapping can last a certain time.

During this trapping the product contained in the distribution circuit can deteriorate or no longer correspond to the filling conditions as defined.

That happens, for example, in the case when the product is intended to be filled at a given temperature, either hot or cold. In effect, if the product in the storage tank is generally maintained at the good temperature, for example due to a forced circulation in a heat exchanger, such is not the case for the product contained in the distribution circuit because this latter in principle is not temperature controlled considering that, when in operation, the product is transported and resides there a very a short time.

In this way, after a shutdown of the filling machine, it is very often necessary to get rid of the product that remained in the distribution circuit. This unusable product is penalized twice, on the one hand from the fact of the material loss and on the other hand because it is necessary to plan an evacuation circuit of this material.

The SUMMARY OF THE INVENTION

The invention therefore has a goal of proposing a solution permitting the resolving of difficulties linked to the presence of material in the distribution circuit at the time of filling machine shutdowns.

To this end, the invention proposes a flowback process, characterized in that it includes a stage consisting in delimiting around the nozzle, by means of a sealed protecting casing, a surrounding enclosure, and a stage during which a pressurized discharge fluid is injected into the surrounding wall, through an auxiliary port, to cause the product contained in the distribution circuit to flow back in the direction of the tank.

According to other characteristics of the process according to the invention the discharge fluid is an inert gas; or the discharge fluid is sterile air.

The invention also proposes a filling machine for implementing the process according to the invention, characterized in that the filling nozzle is enclosed in a casing firmly fixed to a nozzle support. The casing includes an opening opposite which the nozzle is arranged, and the casing including a mobile shut-off butterfly valve that, in a closed position, closes the opening and seals the casing, and in which the machine includes an auxiliary port that opens into the enclosure and that is intended to be connected to a source of pressurized fluid.

According to other characteristics of the machine according to the invention:

an activation device between controls the butterfly shut-off valve. its closed position and an opened position in which the opening of the casing is released;

activation devices of the shutter include a fluid pressure actuator with dual action;

the machine includes means to circulate a cleaning agent, within the casing, the cleaning agent is introduced into the casing by the filling nozzle and is evacuated through the auxiliary port that opens into the inside of the enclosure delimited by the casing;

the auxiliary port is arranged at the low point of the casing;

in the course of filling a sterile gas is injected into the casing through the auxiliary port and evacuated through the opening of the casing while surrounding the flow of the product between the filling nozzle and the container; and the machine includes several filling nozzles each of which is enclosed in a permanent casing provided with a mobile plug permitting the casing to be sealed.

BRIEF DESCRIPTION OF THE DRAWINGS

Other features and advantages of the invention will appear on reading the detailed description that follows, as well as in the drawings attached in which.

DETAILED DESCRIPTION OF ILLUSTRATIVE EMBODIMENTS

Figure 1:
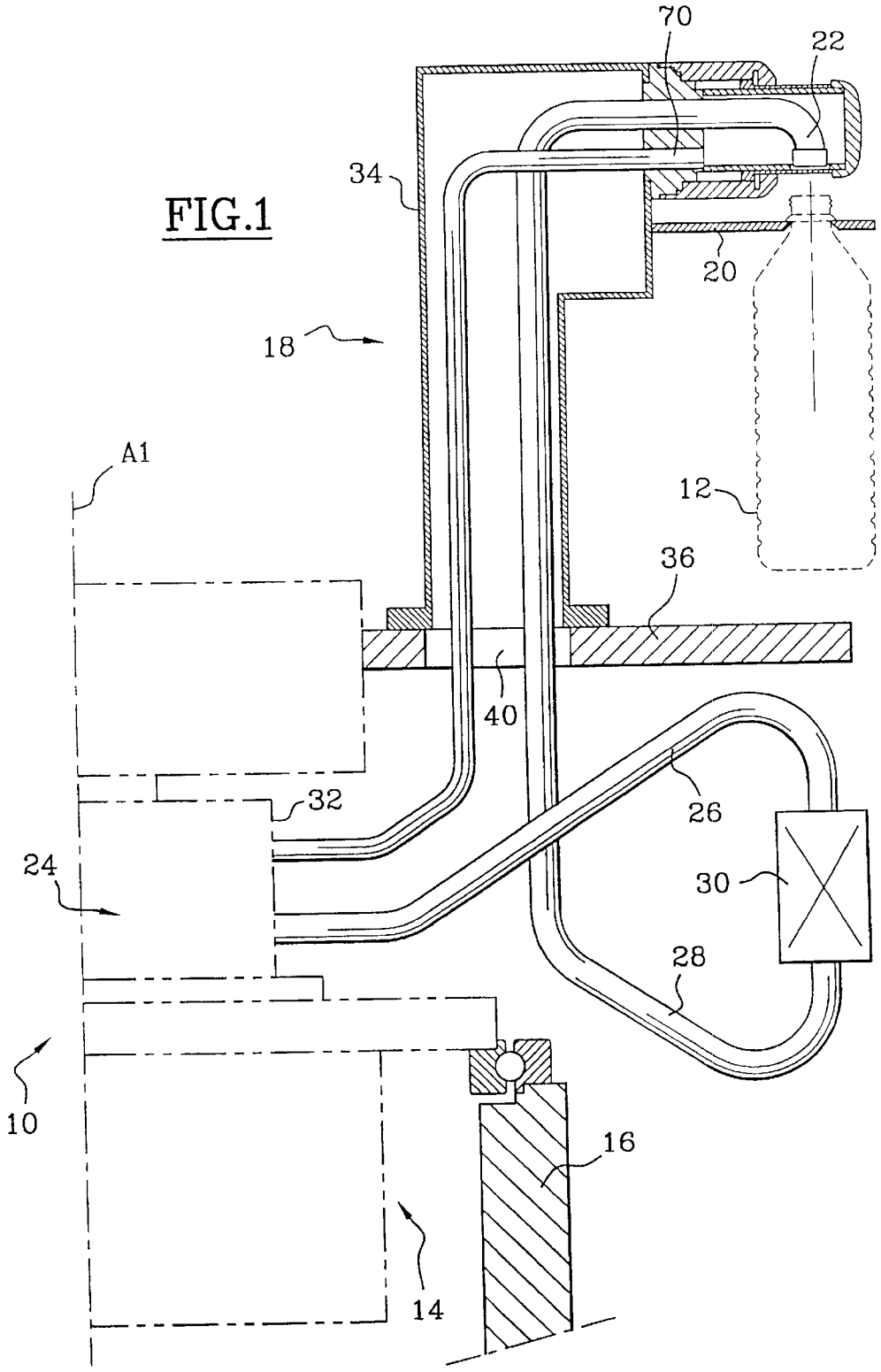
FIG. 1 represents a schematic view in axial cross-section illustrating a part of a carousel of a filling machine designed according to the invention.

In FIG. 1, in a schematic and partial manner, a filling machine 10 is illustrated, intended to ensure the filling of containers, such as the bottles 12, with a liquid, for example a plain liquid such as water. Of course, the invention can be applied in the case of the filling of any type of container with any type of product.

The machine 10 is a rotary machine that includes a rotating carousel 14 mounted with regard to a fixed structure 16, around an axis Al which for convenience, will be qualified as vertical.

The carousel 14 includes a series of filling stations 18 that are angularly separated in a regular manner around the axis Al but where only one is illustrated in the figure. Each filling station 18 is able to perform the filling of a bottle 12. It includes for this purpose specifically a supporting device 20 of a bottle 12, a filling nozzle 22 through which the product flows out intended to fill the bottle, and a distribution circuit that is interposed between a storage tank (not represented) associated with the machine and the nozzle 22.

The distribution circuit specifically includes, but not exclusively, a rotating distributor 24, and for each nozzle, a feed pipe with two sections, upstream 26 and downstream 28, between which is arranged a valve 30 that permits controlling the flow of product in the circuit and therefore the distribution of the product through the associated nozzle 22.

The rotating distributor 24 is arranged in the low part of carousel, at its radial center. It includes a fixed part onto which are connected the feed piping (not represented) which are fixed with regard to the building 16 and that permit supplying the carousel with product from the storage tank specifically, and further, as will appear subsequently, a cleaning agent and pressurized air.

The distributor 24 includes moreover a rotating part 32 onto which are connected pipes which are the feed pipes 26, 28. The two parts of the rotating distributor 24 include means of communication that permit connecting the fixed feed pipes selectively to the corresponding pipes of the carousel.

Each filling station 18 includes a hollow vertical column 34 that is fastened on its lower end onto a horizontal plate 36 and that carries, on its upper end, the filling nozzle 22, which extends toward the outside, essentially according to a radius with regard to the axis A1.

The valve 30 is arranged below the plate 36, essentially on a vertical with the associated filling nozzle 22, so that the downstream section 28 of the feeder extends through a hole 40 of plate 36 and inside the column 34.

According to the invention the filling machine includes devices to delimit, around the nozzle 22, a sealed enclosure and the means to inject into this enclosure a discharge fluid which permits pushing back the product contained in the distribution circuit in the direction of the storage tank.

For this purpose, the column 34 of the machine described, carries at its upper end a casing 38 in which is enclosed the filling nozzle 22.

Figure 2:
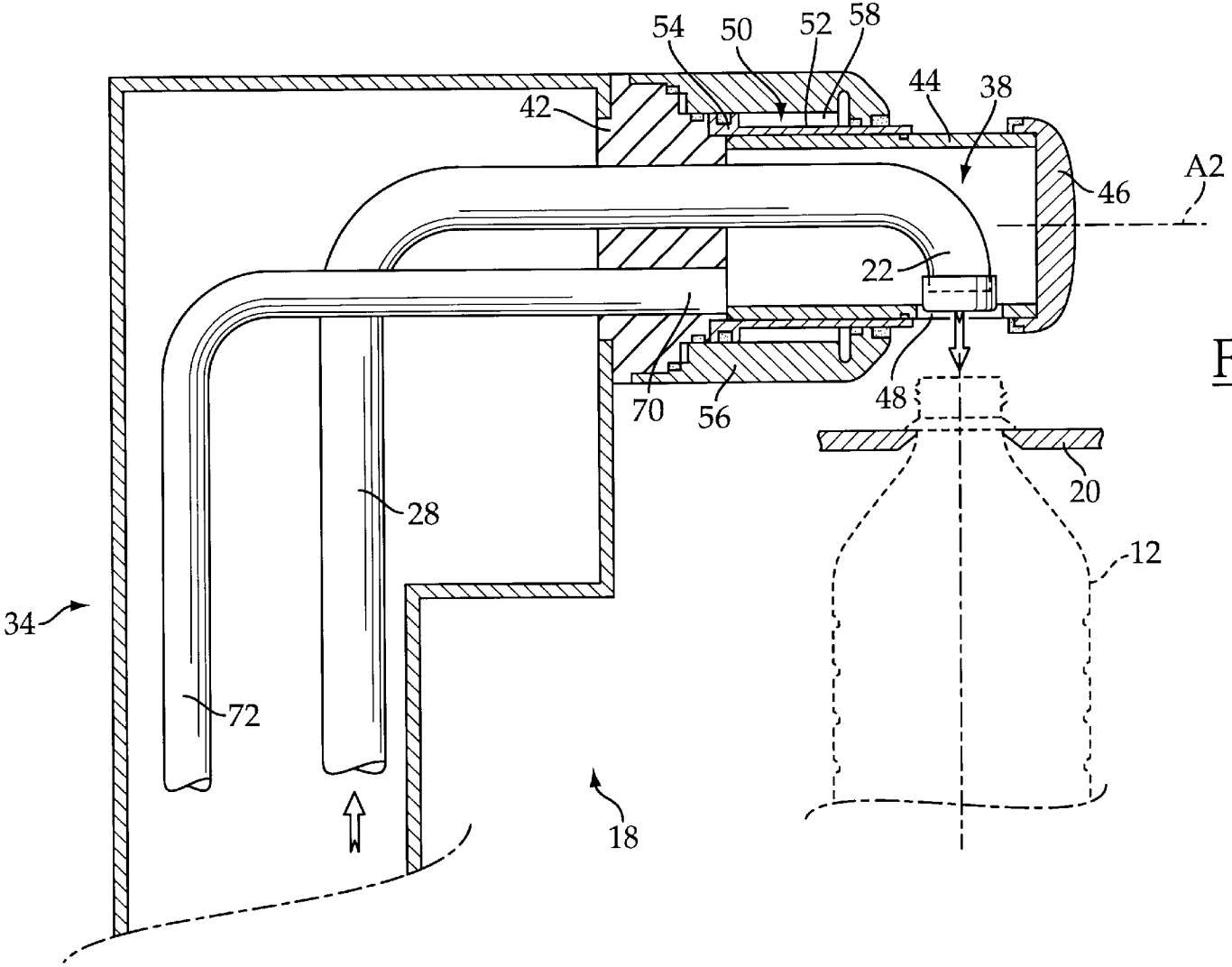
FIG. 2 is a view in detail of FIG. 1 showing more specifically the cleaning casing of a filling nozzle as well as a butterfly shut-off valve and its activation device, the butterfly valve being illustrated in open position.
Figure 3:
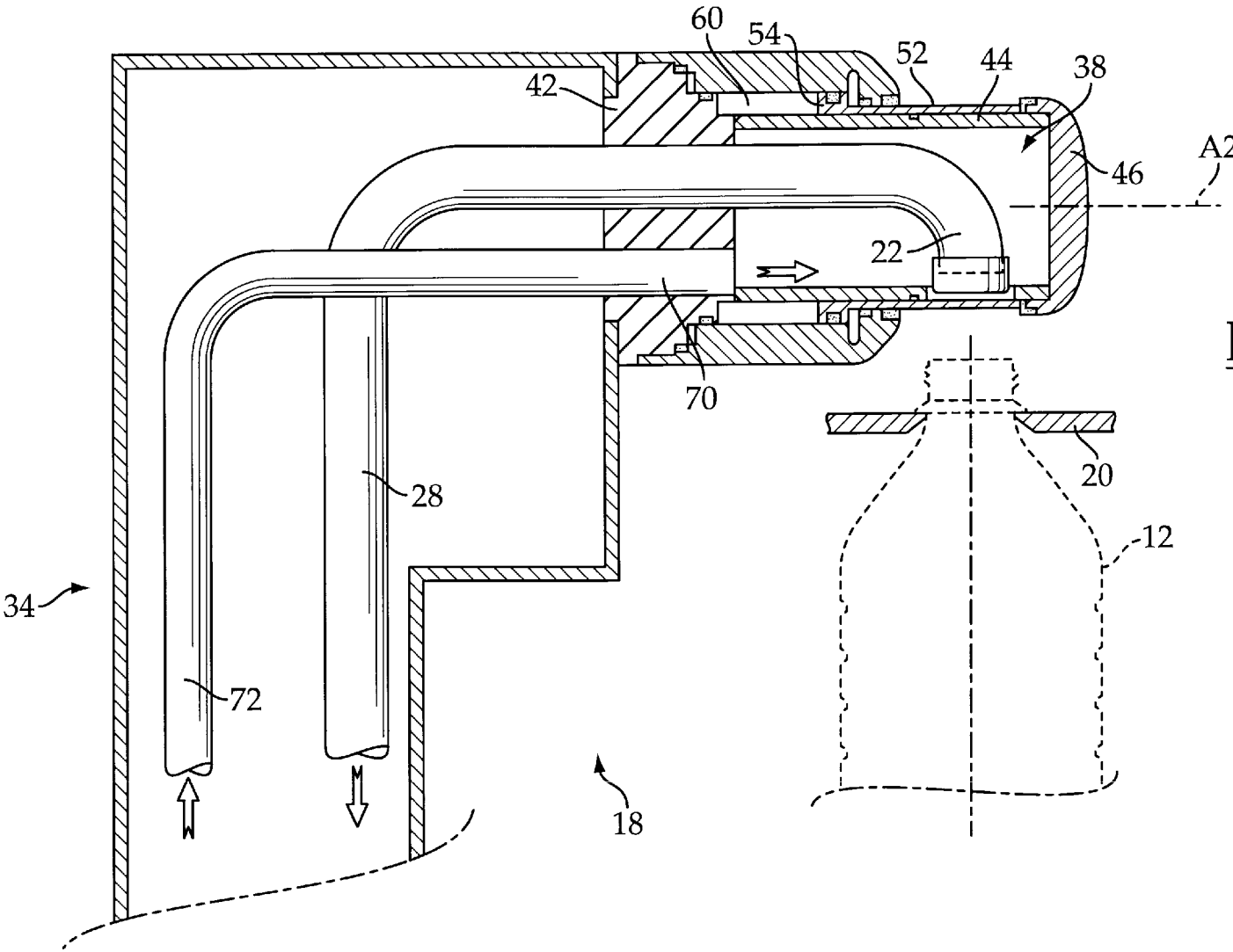
FIG. 3 is an identical view to the one of FIG. 2 in which the butterfly valve is illustrated in closed position.

As can be seen more specifically in FIGS. 2 and 3, the terminal part of the downstream section 28 of the feeder extends in a radial plane with regard to the Al axis, so that the casing is fixed radially in excrescence on the outer side with regard to column 34. The casing 38 includes a base 42 that is fixed on the column 34 and that extends radially outward by a tubular partition of revolution 44 with radial axis A2. The partition 44 is closed at its outer radial end by an end partition 46 that is constituted for example by a sealing plug screwed on the partition 44.

The terminal part of the feeder pipe 28 traverses the base 42 in a sealed fashion to open into the enclosure delimited by the tubular partition 44. The filling nozzle 22 is curved downwards to be positioned over an opening 48 arranged in the partition 44, this opening 48 is itself opposite the filling opening of the bottle 12 when the latter is in place on its support 20.

The casing 38 advantageously includes a mobile butterfly valve 50 that permits blocking off opening 48 so that the casing delimits a perfectly closed and sealed enclosure in which the nozzle 22 is enclosed.

The butterfly valve 50 is constituted of a tubular sleeve 52 of revolution that is mounted by sliding up over the tubular partition 44. The butterfly valve 50 can thus move between an open position illustrated in FIG. 2, into which it is withdrawn in order to clear the orifice 48, and a plugged position illustrated in FIG. 3, in which it is advanced so as to cover the orifice 48.

The rear edge end of the sleeve 52 has the shape of a collar 54 that slides in an sealed manner inside an annular chamber delimited around the tubular partition 44 by a tubular shell 56 with axis A2 that surrounds the rear edge of partition 44. The collar 54 thus plays the role of a piston that delimits the two, front 58 and rear 60, parts in the chamber. The respective volumes of these two parts 58, 60 are therefore variable according to a position of the collar, and therefore the position of the butterfly valve 50, along the A2 axis.

Also, by imposing a fluid pressure on one or another of the parts 58, 60 of the chamber, a displacement is imposed on the butterfly valve 50 toward one or the other of its positions open or closed. In other terms, the collar 54 and the two parts 58, 60 of the chamber form a fluid pressure actuator with dual action.

When the machine includes several nozzles, it can be foreseen that every filling station 18 is provided with its own solenoid control valve (not represented) of the butterfly valve 50. The activation of butterfly valves 50 is done individually and then can be possibly staggered in time from one nozzle to another. However, when the machine includes a significant number of filling nozzles, the machine can include one unique control solenoid valve for all nozzles.

In the two cases the activation of butterfly valves 50 can, due to the invention, be done simultaneously on all nozzles in a very short time. And fortunately the activation of butterfly valves can even be done when the carousel is in rotation.

Otherwise, the machine according to the invention includes, for every nozzle 22, an auxiliary port 70 that is distributed in the base 42 and that opens into the inside of the enclosure defined by the corresponding casing 38. The auxiliary port 70 is connected by an auxiliary pipe 72 and by a distributor 24 to a fluid feed device for pressurized discharge.

Thus, following a shutdown of the filling machine it is possible to cause the closing of the casing 38 via the butterfly valve 50 and to inject the pressurized fluid in the casing 38 by means of the auxiliary port 70. The fluid pressure provokes a withdrawal of the product then contained in the distribution circuit. It will be foreseen that, during the flowback, valve 30 is open, in order to allow the product to flow back in the direction of the storage tank.

The discharge fluid is determined according to the filling product. In most cases, an inert gas may use to good advantage such as sterile air.

The flowback is interrupted when the fluid is drawn down to a desired level, a level that may to be noted either visually, due to a transparent section of piping interposed for example in the distribution circuit on the outlet of storage tank, or in automatic fashion, due to an otherwise recognized detector.

The flowback is interrupted simply by halting the supply of pressurized fluid to the casing. On the outlet of storage tank may be usefully foreseen a shut-off valve that will be closed again as soon as the product is drawn down to the desired level.

In other respects, the filling operation must be done of course by avoiding any contamination of the product. It is crucial when the product is a food product, and even more so in the case of dairy products, for example.

Also, it is necessary to carry out the cleaning of the filling machine at regular intervals. The cleaning can consist of removing any trace of the product, removing dust and other foreign bodies, or indeed eliminating the biologic or bacteriological contamination. In the sense of the present patent the cleaning can therefore equally well cover the notions of washing, decontamination, disinfecting or sterilization.

The cleaning is generally realized with the help of a liquid or gaseous cleaning agent which is caused to circulate in the circuit used for the product into the inside of the machine. To limit the consumption of cleaning agent, and especially to facilitate its recovery with a view of its possible recycling, the circulation of the agent in a closed circuit is preferred.

However, when the casing 38 is closed by the butterfly valve 50, it is possible to organize inside it a circulation of a cleaning agent permitting not only cleaning the inside the nozzle 22, but also outside it. To do this, a circulation a cleaning liquid is performed for example through the intake pipe, the valve 30 and the nozzle 22, that fills the casing 38. The liquid is then evacuated from the casing through the auxiliary port 70 which is then connected by the auxiliary pipe 72 and by the distributor 24 to a recovery and recycling device of the cleaning liquid, which permits limiting its consumption.

Preferably, the auxiliary port 70 is arranged so as to come out at the low point of the casing 38 to permit as complete an evacuation as possible of the cleaning liquid via the auxiliary pipe 72.

In an advantageous manner, so as to improve the cleanliness qualities of the filling again with the help of such a machine, can be foreseen injecting a sterile gas inside the casing 30, at the time of the filling, such as the sterile air, nitrogen or carbon dioxide. The sterile gas then fills the internal volume of the casing 38 and escapes through the opening 48 while surrounding the jet of product that is delivered via the filling nozzle in the direction of the bottle 12. Thus, between the nozzle 22 and the bottle 12, the product is isolated by a sterile gas envelope and is not exposed to possible surrounding sources of pollution. Advantageously, the sterile gas can be introduced into the casing 30 through the same auxiliary port 70 that serves for the evacuation of the cleaning agent during the cleaning phases of the machine.

Due to the invention, the flowback operation of the product during a shutdown of the machine can be done in a rapid manner for all the machine's filling stations, which avoids any loss of product. In addition, the flowback is done with an inert fluid for the product in question, the start up of the machine can be done again without it being necessary to proceed compulsorily to a special cleaning of the distribution circuit, except of course in the case of a prolonged shutdown, in which case the cleaning operation as previously described can be implemented in a particularly simple manner.

We claim:

1. A filling machine, said filling machine comprising:

a distribution circuit connecting, from upstream to downstream, a storage tank of a product to a filling nozzle, the filling nozzle being positioned opposite an opening of a container to be filled;

a fixed casing which supports and encloses the nozzle, the casing having an opening opposite the nozzle;

a mobile shut-off butterfly valve which, in a closed position, plugs the opening and seals the casing; and an auxiliary port that opens into the enclosure, the auxiliary port being connected to a source of pressurized discharge fluid, so that the pressurized discharge fluid is injected in the enclosure when the butterfly valve is in the closed position, and the product contained in the distribution circuit is compressed in a direction of the storage tank so that a portion of the product is removed from the distribution circuit.

2. The filling machine according to claim 1, wherein the butterfly shut-off valve is controlled by means of activation between the closed position and an opened position in which the opening in the casing is released.

3. The filling machine according to claim 2, wherein the means of activation of the butterfly valve includes a fluid pressure actuator with dual action.

4. The filling machine according to claim 1, wherein the machine includes a device to have a cleaning agent circulate, inside of the casing, the cleaning agent being introduced into the casing by the filling nozzle and is evacuated through the auxiliary port.

5. The filling machine according to claim 1, wherein the auxiliary port is arranged at a low point of the casing.

6. The filling machine according to claim 1, wherein, during filling, a sterile gas is injected into the casing through the auxiliary port and is evacuated through the opening of the casing while surrounding a flow of the product between the filling nozzle and the container.

7. The filling machine according to claim 1, further comprising several filling nozzles of which each is enclosed in a fixed casing provided with a mobile plug permitting sealing off of the casing.

8. A process of flowback of a product contained in a distribution circuit of a filling machine, the distribution circuit connecting, from upstream to down-stream, a storage tank of the product to a filling nozzle, the filling nozzle being positioned opposite an opening of a container to be filled, the process comprising:

delimiting an enclosure around the nozzle, by sealing a casing; and injecting a pressurized discharge fluid in the enclosure, through an auxiliary port, so as to push back the product contained in the distribution circuit in a direction of the storage tank.

9. The process according to claim 8, wherein the flowback fluid is an inert gas.

10. The process according to claim 9, wherein the discharge fluid is sterile air.

* * * * *

UNITED STATES PATENT AND TRADEMARK OFFICE

CERTIFICATE OF CORRECTION

PATENT NO. : 6,453,953 B1 
DATED : September 24, 2002
INVENTOR(S) : Eric Adriansens, Eric Meunier and Rodolphe Saint-Martin It is certified that error appears in the above-identified patent and that said Letters Patent is hereby corrected as shown below:

Column 1,
Line 25, please change “perform” to -- performed --.
Line 51, please delete the second occurrence of “a”

Column 2,
Line 25, please change the “.” to a -- , --.

Column 4,
Line 56, please change “may use” to -- may be used --.

Column 5,
Line 21, please insert -- of -- after “circulation”.

Signed and Sealed this

Twenty-second Day of July, 2003

JAMES E. ROGAN
*Director of the United States Patent and Trademark Office*